United States Patent [19]

McFadden et al.

[11] 4,156,792

[45] May 29, 1979

[54] ELECTRIC FURNACE CONSTRUCTION

[75] Inventors: Charles A. McFadden, Medford, N.J.; William N. Rosenberg, Broomall, Pa.

[73] Assignee: Bickley Furnaces Incorporated, Philadelphia, Pa.

[21] Appl. No.: 833,156

[22] Filed: Sep. 14, 1977

[51] Int. Cl.[2] ..... H05B 3/06

[52] U.S. Cl. ..... 13/25; 13/35

[58] Field of Search ..... 13/20, 22, 25, 35; 219/98, 99; 110/1 A, 336

[56] References Cited

U.S. PATENT DOCUMENTS

| | | | |
|---|---|---|---|
| 3,368,802 | 2/1968 | Morgan et al. | 110/1 A X |
| 3,705,253 | 12/1972 | Hicks | 13/25 X |
| 3,706,870 | 12/1972 | Sauder et al. | 219/99 X |
| 3,742,670 | 7/1973 | Byrd, Jr. | 110/1 A X |
| 3,892,396 | 7/1975 | Monaghen | 110/1 A X |
| 4,011,394 | 3/1977 | Shelley | 13/25 X |

FOREIGN PATENT DOCUMENTS

| | | | |
|---|---|---|---|
| 1359291 | 7/1974 | United Kingdom | 110/1 A |

*Primary Examiner*—R. N. Envall, Jr.

*Attorney, Agent, or Firm*—Harding, Earley & Follmer

[57] ABSTRACT

An electric furnace construction comprises a furnace wall including a metallic outer shell and a liner of soft ceramic fiber insulation material on the interior wall of the shell, and a plurality of pin assemblies for holding the lining tightly against the shell and for supporting electric heating means.

13 Claims, 6 Drawing Figures

ELECTRIC FURNACE CONSTRUCTION

BACKGROUND AND SUMMARY OF THE INVENTION

This invention relates to the construction of an electric furnace in which the furnace wall includes a liner of ceramic insulating material.

Electric furnaces have been provided with a metallic outer shell and a liner of ceramic insulating material, one such furnace construction being shown in U.S. Pat. No. 3,987,237. However, this prior construction requires the use of a liner constructed of a fiberboard or "hardboard" type of insulating material, which type of construction is very expensive. In U.S. Pat. No. 3,705,253, there is shown an electric furnace employing a fibrous insulating material as a liner. However, the means for securing the insulating material onto the wall is unsatisfactory in that it does not hold the insulation material properly and cannot be replaced feasibly.

It is the general object of the invention to provide an electric furnace construction in which the furnace wall is comprised of an outer shell and a liner of a soft ceramic fiber insulating material. There is provided liner holding means comprising novel pin assemblies which simultaneously hold the liner tightly against the shell and provide a mechanical support for the electric heating means.

A feature of the novel pin assembly construction is that it provides mechanical flexibility to accommodate strip or coiled wire type of metallic heating elements of various dimensions. Also, the design permits easy replacement of the pins of the pin assemblies in a minimum of time. It is noted that the pins are arranged to carry the heating elements in a cantilevered or overhung arrangement so that they are subject to occasional breakage and must be replaced. The design of the invention is such that the pins can be replaced with little or no damage to the ceramic fiber material which is weak by reason of its soft fiberlike composition. Furthermore, the pin assemblies are constructed to locate the heating elements so as to be positioned a reasonable distance from the hot face of the ceramic material which arrangement is important in that if the heating element is permitted to come too close to the fiber, localized overheating and premature failure of the heating elements will result.

DESCRIPTION OF THE PREFERRED EMBODIMENT OF THE INVENTION

Figure 1:
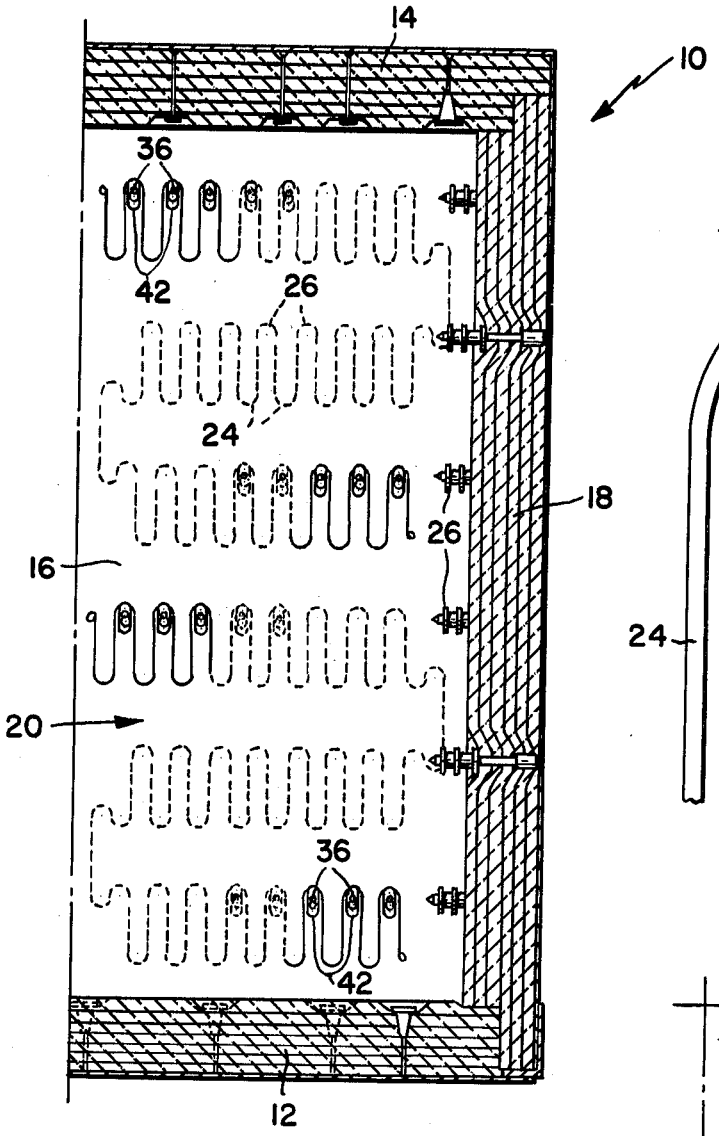
FIG. 1 is a sectional view, in elevation, of an electric furnace constructed in accordance with the invention.

FIG. 1 shows an electric furnace comprising a floor 12, a ceiling 14, a side wall 16 and an end wall 18. Furnace 10 also comprises a side wall (not shown) in spaced opposed relation to side wall 16 and an end wall (not shown) in spaced opposed relation to the end wall 18. The walls of furnace 10 are arranged to provide a generally rectangular construction defining an enclosed heating chamber 20. The side and end walls of furnace 10 are provided with arrays of serpentine-shaped electric heating elements 24 in the form of metallic strips or ribbons supported on pin assemblies 26 in accordance with the invention. In FIG. 1, the heating elements 24 are not shown in their supported position on the pin assemblies 26 mounted on the end wall 18 for the sake of clarity of illustration.

Figure 2:
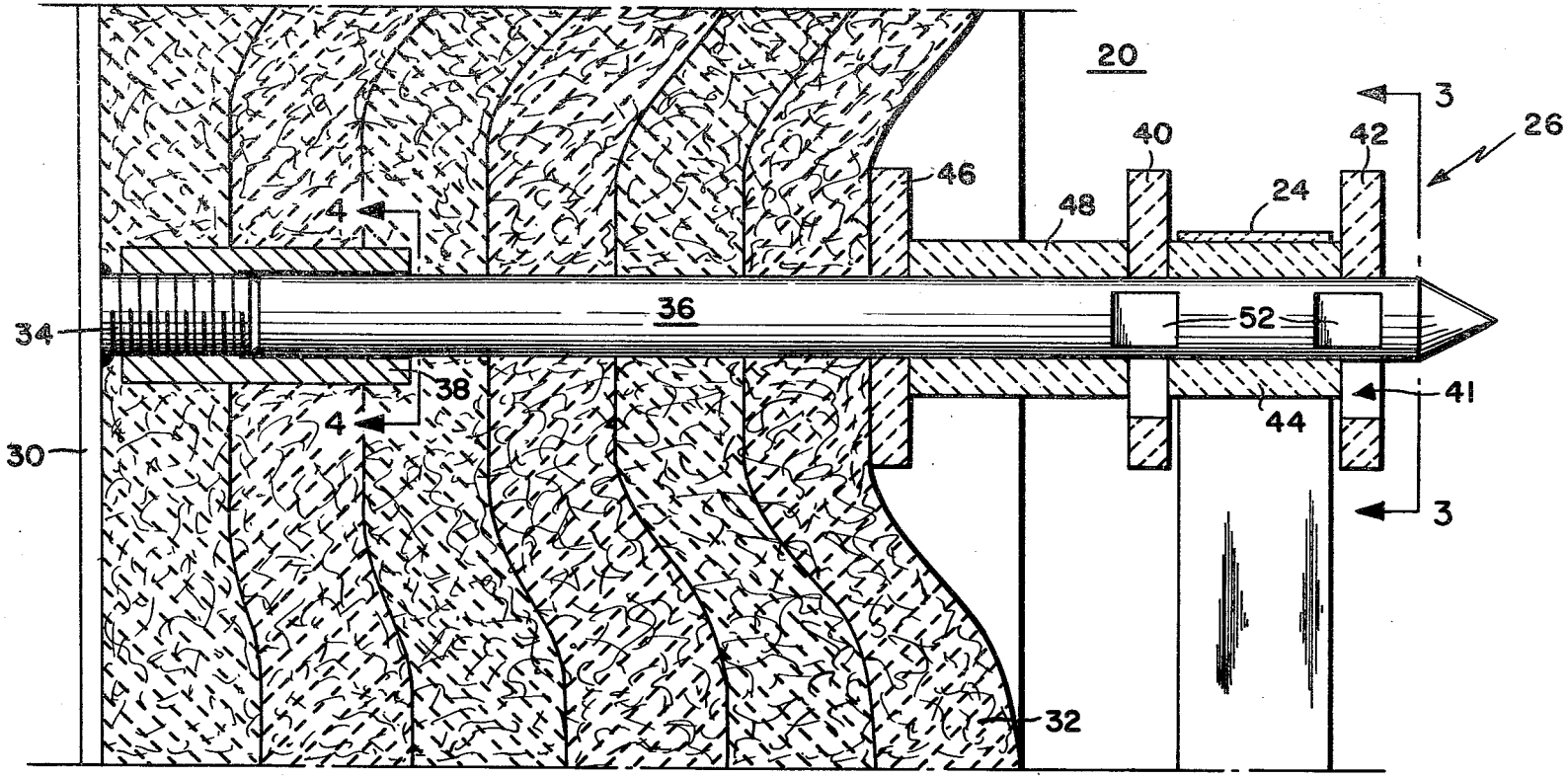
FIG. 2 is a detail view showing a pin assembly in accordance with the invention.

The side and end walls of furnace 10 are constructed of a metallic outer shell and an insulating liner of a soft fibrous ceramic insulating material. Referring to FIG. 2, side wall 16 comprises an outer shell 30 and an insulating liner 32 held tightly against shell 30 by means of pin assemblies 26. Referring to FIG. 1, end wall 18, ceiling 14, and floor 12 have a construction similar to side wall 16 and comprise a metallic outer shell and an internal insulating liner.

As is conventional in the art, the outer shells, such as shell 30, are made of steel.

The liner 32 for side wall 16, as well as the other insulating liners, is made of a plurality of layers of soft fibrous ceramic insulating material. Insulating material of this type is made in the form of blankets of resilient, lightweight batting of long ceramic fibers mixed in a binder. Blankets suitable for use in furnace 10 are three feet wide, five feet long and one inch in thickness. These blankets have good insulating properties and insulate effectively to high temperatures. Typically, blankets are available for furnace applications of about 2300° F. Of course, a blanket with suitable heat insulating properties must be selected for the particular furnace application. Suitable blankets for use as liners 32 in accordance with the invention are Fiberfrax PH blankets and Fiberfrax Lo-Con felt manufactured by the Carborundum Company and Kaowool Ceramic Fiber blankets manufactured by Babcock and Wilcox Inc.

Typically the insulating liners are comprised of six layers of blankets arranged in side-by-side relation with the ends staggered and overlapped. Of course, various arrangements may be used in accordance with the furnace construction and operating temperatures.

Each of the pin assemblies 26 comprises a stud 34 secured to shell 30, a pin 36 extending from stud 34 in a cantilevered arrangement through liner 32 into the interior of the furnace 10, a collar 38 removably securing pin 36 onto stud 34, a pair of collars 40 and 42 mounted on the free end of pin 36, a sleeve 44 positioned on pin 36 between collars 40 and 42, a washer 46 mounted on pin 36 for contacting the inner or hot face 33 of liner 32, and a sleeve 48 mounted on pin 36 between collar 30 and washer 46. All of the parts of each pin assembly 23 are made of materials capable of withstanding the high temperatures of electric furnaces. Stud 34 and collar 38 are made of metal and the remaining parts of pin assembly 26 are made of ceramic.

Figure 4:
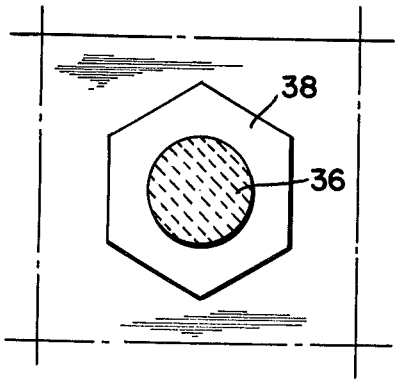
FIG. 4 is a section taken on line 4—4 of FIG. 2.

Stud 34 is welded to the inner wall of shell 30 and is externally threaded for threadedly engaging collar 38 which is internally threaded at one end. The other end of collar 38 receives the end of pin 36 which is cemented in place within collar 38. Collar 38 has a hexagonal shaped outer wall, as is shown in FIG. 4, adapted to be engaged by an elongated socket wrench for unscrewing collar 38 from threaded engagement with stud 34. This removable arrangement permits the easy replacement of a broken pin 36 which is removable from its supported position on stud 34 along with its connected collar 38. After a broken pin 36 and its connected collar 38 are removed, a new collar 38 and a new pin 36 cemented in place in the new collar 38 can be quickly reinstalled onto stud 34 by threading the new collar 38 thereon. Moreover, this replacement can be achieved with little or no damage to the relatively fragile liner 32.

Figure 3:
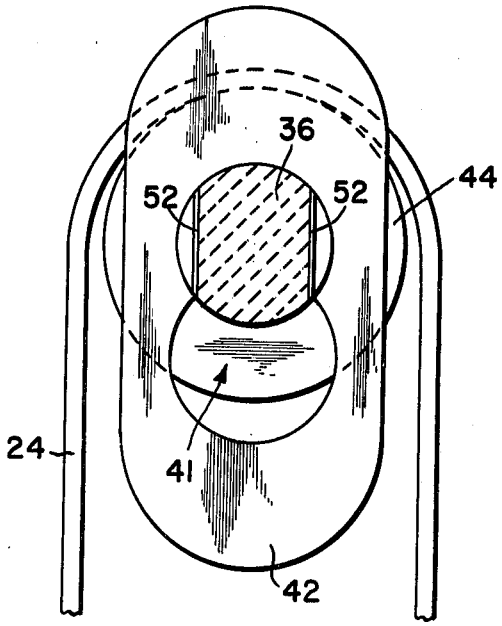
FIG. 3 is a section taken on line 3—3 of FIG. 2.
Figure 5:
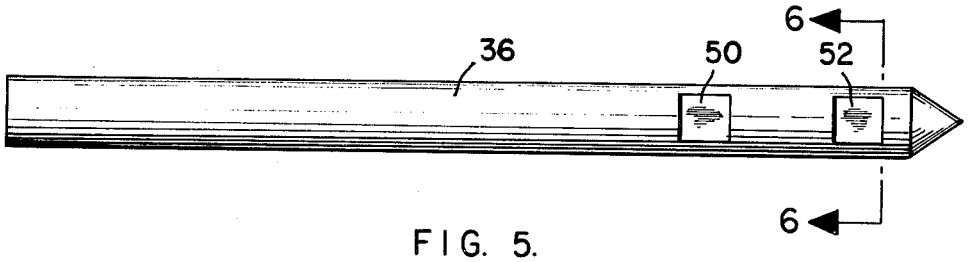
FIG. 5 is a detail view showing a pin employed on the pin assembly shown in FIG. 2.
Figure 6:
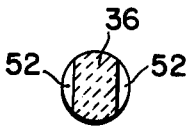
FIG. 6 is a section taken on line 6—6 of FIG. 5.

Collars 40 and 42 and sleeve 44 provide a cradle-like support for a heating element 24 and function to locate the heating element 24 so that it is a predetermined safe distance away from the hot face 33 of liner 32. This mounting arrangement prevents localized overheating and premature failure of the heating elements 24. To this end, the pin 36 is provided with axially spaced pairs of recessed portions 50 and 52 and the collars 40 and 42 are adapted to be removably positioned in these recessed portions 50 and 52. Each of the pairs of recessed portions 50 and 52 comprises a pair of diametrically opposed parallel flats as is shown in FIGS. 5 and 6. Each of the collars 40 and 42 is provided with a central opening 41 having a straight-sided portion and a circular portion as shown in FIG. 3. The circular portion of each central opening 41 is adapted to slide over the circular outer wall of the pin 36 and the straight-sided portion of each central opening 41 is adapted to fit over the recessed portions 50 and 52 of the pin 36 as is apparent from a consideration of FIGS. 2 and 3. By this arrangement, the collar 40 or 42 is assembled onto a pin 36 at one of the recessed portions 50 or 52 by sliding the pin 36 through the circular portion of the central openings 41 until the desired recessed portion is reached, whereupon collar 40 or 42 is lowered to position the straight-sided portion of the central opening 41 adjacent the parallel flats of the recessed portions 50 or 52. A collar 40 or 42 is removed from a pin 36 by a movement which is the reverse of the assembly procedure described above.

The recessed portions 50 and 52 have an axial extent greater than the thickness of collars 40 and 42. Accordingly, collars 40 and 42 can be positioned at various spacings to accommodate different widths of heating elements 24. The spacing between collars 40 and 42 will be determined by the length of the spacer 44 which is selected in accordance with the width of the heating element 24 to be supported.

The pin assemblies 26 are designed to hold liner 32 tightly against the shell 30. To this end, each pin assembly 26 is dimensioned so that sleeve 48 positions washer 46 at a location to compress liner 34 to a width smaller than the normal width thereof. This is illustrated in FIG. 2 wherein the hot face 33 of liner 32 is shown at its uncompressed location in relation to the compressed portion of liner 32 in the area of washer 36. Typically, a six inch thick liner 32 would be compressed to about five inches by the washer 46 of each pin assembly 26. By this arrangement, liner 32 is held tightly against shell 30 to thereby improve the heat insulating properties of liner 32.

It will be apparent that various changes and modifications can be made in the construction and arrangements of parts without departing from the scope of the invention. Thus, the ceramic pin 36 may be attached to the steel shell 30 in various ways and many different ways may be employed to mount the ceramic sleeves 44 and 48 on the outer end of the ceramic pin 36 within the broad concept of the invention of putting the heating element support piece on the shell of the furnace.

Illustrative of various ways of attaching the pin 36 to the shell 30 is the provision of a pipe sleeve welded onto the shell and receiving the ceramic pin therein, with a cotter pin being used to secure the ceramic pin in place within the pipe sleeve. The pipe sleeve can be mounted either on the inside of the shell or to extend to the outside of the shell and the cotter pin can be located either inside or outside of the shell.

Another way of attaching the ceramic pin to the steel shell is by the use of a metal sleeve mounted on the shell by the use of either a bolt or a nut means. The metal shell is adapted to receive the ceramic pin therein with the ceramic pin being held in position either by a cotter pin or by the use of a threaded engagement between the metal sleeve and the ceramic pin.

Illustrative of the various ways of mounting the sleeves 44 and 48 on the outer end of the ceramic pin is to utilize a ceramic washer having a threaded hole adapted to threadedly engage an externally threaded end of the ceramic pin. This threaded washer would replace the washer 42 on the end of the pin 36 as shown in FIG. 2. Also, the end washer may be secured in position on the ceramic pin by the use of a ceramic dowel pin received in a transverse hole in the end of the ceramic pin.

Another way of mounting the sleeve on the outer end of the ceramic pin is to replace the collars 40 and 42 and the end sleeve 44 with a ceramic spool having a similar configuration. The spool is adapted to support the heating elements 24 and is secured in position on the end of the ceramic pin as by threaded engagement with a threaded end of the ceramic pin or by the use of a ceramic dowel pin received in aligned holes in the ceramic pin and the ceramic spool.

It will be apparent that various other modifications are possible and that these modifications are within the scope of the invention as defined by the following claims.

We claim:

1. An electric furnace construction comprising:
electric heating means,
a furnace wall including a shell and a liner of a soft ceramic fiber insulating material on the interior wall of said shell,
and a plurality of pin assemblies,
each of said pin assemblies including means for holding said liner tightly against said shell, and
means for supporting said electric heating means,
each of said pin assemblies including a pin extending through said liner to the interior of the furnace and means for removably mounting said pin on said shell so that said pin is replaceable, 2. An electric furnace construction according to claim 1 wherein said sleeve is threadedly connected to said stud, said stud is metallic, and said sleeve has a straight-sided outer wall adapted for engagement by a removing tool.

3. An electric furnace construction according to claim 2 wherein each of said pin assemblies includes means on the free end of said pin for supporting said electric heating means at a predetermined location spaced away from the inner wall of said liner.

4. An electric furnace construction according to claim 3 wherein said means for supporting the electric heating means comprises a pair of retaining washers mounted in spaced apart relation on said pin and a sleeve mounted on said pin between said pair of retaining washers.

5. An electric furnace construction according to claim 4 wherein each of said pin assemblies includes means on said pin for contacting the inner wall of said lining to compress said lining and to urge said lining toward said shell, said last-named means including a washer mounted on said pin and a sleeve for positioning said washer at a predetermined position on said pin in contact with said lining.

6. An electric furnace construction according to claim 5 wherein said retaining washers are engageable with said pin at a predetermined axial location on said pin and are removable from said mounted position on said pin.

7. An electric furnace construction according to claim 6 wherein said pin of each of said pin assemblies is provided with reduced diameter portions at said predetermined axial locations whereat said retaining washers are located.

8. An electric furnace construction according to claim 5 wherein said liner includes a plurality of layers of blankets of soft ceramic fibrous material.

9. An electric furnace construction according to claim 1 wherein said liner includes a plurality of layers of blankets of soft ceramic fibrous material.

10. An electric furnace construction comprising electric heating means, a furnace wall including a shell and a liner of a soft ceramic fiber insulating material on the interior wall of the shell, and a plurality of pin assemblies, each of said pin assemblies including means for holding said liner tightly against said shell, means for supporting said electric heating means, a pin extending through said liner to the exterior of the furnace, means for removably mounting said pin on said shell so that said pin is replaceable, and means on the free end of said pin for supporting electric heating means at a predetermined location spaced away from the inner wall of said liner, said pin mounting means including a sleeve member secured to the mounted end of said pin and means for removably mounting said sleeve on said shell.

11. An electric furnace construction according to claim 1 wherein each of said pin assemblies includes means on said pin for contacting the inner wall of said lining to compress said lining and to urge said lining toward said shell, said last-named means including a washer mounted on said pin and a sleeve for positioning said washer at a predetermined position on said pin in contact with said lining.

12. An electric furnace construction according to claim 11 wherein each of said pin assemblies includes means on the free end of said pin for supporting said electric heating means at a predetermined location spaced away from the inner wall of said liner.

13. An electric furnace construction according to claim 11 wherein said liner includes a plurality of layers of blankets of soft ceramic fibrous material.

* * * * *

UNITED STATES PATENT OFFICE

CERTIFICATE OF CORRECTION

Patent No. 4,156,792 Dated May 29, 1979

Inventor(s) Charles A. McFadden et al.

It is certified that error appears in the above-identified patent and that said Letters Patent are hereby corrected as shown below:

After the comma (,) in line 49 of column 4 (claim 1), insert the following paragraph:

-- said pin mounting means comprising a stud secured to said shell and a sleeve removably connected to said stud and secured to an end of said pin.--

Signed and Sealed this

*Twenty-fifth* Day of *September 1979*

[SEAL]

*Attest:*

*Attesting Officer*

LUTRELLE F. PARKER

*Acting Commissioner of Patents and Trademarks*